United States Patent [19]

Laffin

[11] Patent Number: 4,662,346

[45] Date of Patent: May 5, 1987

[54] LOADED ARROW HOLDER

[76] Inventor: Gerald A. Laffin, E 17 497 Hwy. 52, Aniwa, Wis. 54408

[21] Appl. No.: 777,500

[22] Filed: Sep. 19, 1985

[51] Int. Cl.[4] ..... F41B 5/00

[52] U.S. Cl. ..... 124/41 A; 124/24 R

[58] Field of Search ..... 124/41 A, 41 R, 88, 124/86, 24 R, 24 A

[56] References Cited

U.S. PATENT DOCUMENTS

| | | | |
|---|---|---|---|
| 3,059,631 | 7/1959 | Yasho | 124/41 A |
| 3,244,161 | 4/1966 | Jenson | 124/24 R |
| 3,406,676 | 10/1968 | Dye | 124/41 R |
| 3,698,375 | 10/1972 | Brougham | 124/24 R |
| 4,038,960 | 8/1977 | Ludwig | 124/41 A |
| 4,332,232 | 6/1982 | Troncoso, Jr. | 124/24 R |
| 4,351,311 | 9/1982 | Phares | 124/41 A |
| 4,372,282 | 2/1983 | Sanders | 124/24 R |
| 4,569,325 | 2/1986 | Christian | 124/41 A |
| 4,577,612 | 3/1986 | Zell | 124/41 A |

*Primary Examiner*—Richard C. Pinkham
*Assistant Examiner*—Gary Jackson
*Attorney, Agent, or Firm*—Isaksen, Lathrop, Esch, Hart & Clark

[57] ABSTRACT

An arrow holder is disclosed which, when properly used with a conventional bow, allows an archer to laterally load an arrow onto an arrow rest or other support surface on the bow, to laterally confine the loaded arrow such that accidental separation of the arrow from the bow is prevented, and to repeatedly move the arrow longitudinally on the support surface of the bow. The arrow holder includes a plurality of prongs at least one of which is movable between an open position in which the arrow may be laterally loaded onto the support surface and a closed position in which a loaded arrow is laterally confined. Means for adjusting the position of the prongs, means for minimizing contact between the arrow and the arrow holder, and means for biasing the prongs to the closed position are also disclosed.

28 Claims, 10 Drawing Figures

LOADED ARROW HOLDER

TECHNICAL FIELD

This invention relates to archery equipment and particularly to arrow holders which prevent loaded arrows from laterally falling off the surfaces upon which they rest.

BACKGROUND OF THE INVENTION

Archers, particularly hunters, are commonly confronted with a variety of conditions which call for quick reaction to events of limited duration. In game or on the hunt, the speed with which an archer can aim and draw an arrow is often determinative of success. Because of this emphasis on readiness, it is not unusual for archers to load arrows well before they expect to shoot. Loading involves both supporting the mid portion of the arrow shaft upon an arrow rest or other support surface positioned near the center of the body of the bow, and nocking the nock end of the arrow upon the undrawn bow string. For convenience and speed, experienced archers are often able to place the shaft of an arrow on its support and nock the arrow to the bow string in a substantially simultaneous manner. This conventional loading process requires, however, that the archer be able to advance the arrow to the support surface from a direction which is lateral to the longitudinal axis of its shaft.

After loading the arrow, an archer in the field is often confronted with a variety of conditions which call for repeated aiming, drawing and retracting the arrow before making an actual shot. Sometimes the bow must be tilted in order to effect the required shot. Because of these adjustments, which precede the final draw and release, the arrow shaft can often easily be dislodged from the arrow rest. In such cases the archer must often reload at the expense of time. In some cases, particularly where an archer must rapidly adjust his aim while drawing, the arrow shaft may even fall from the support surface just as the arrow is being shot. When this occurs, spurious, and potentially dangerous, shots are likely.

Various types of devices have been developed to deal with the problem of preventing a loaded arrow from falling from its bow support. Slanted or stepped rests have been designed to bias the loaded arrow shaft toward the body of the bow. While these rests have proven somewhat successful in preventing arrow slippage, they are clearly of limited benefit where an arrow may be dislocated vertically or otherwise sufficiently dislodged to overcome the bias of the rest. The biased support surface can in some instances even affect the accuracy of the shot. Other devices clamp to the arrow shaft, sometimes with sufficient force to hold the arrow in drawn position. While these devices are useful for holding an arrow onto a bow for extended periods of time, they generally must be released before the arrow can be repeatedly drawn and retracted. Thus the potential for dislocation is restored just when some archers require the aid of a holding device. Another type of device flexibly contacts the arrow shaft so that the arrow is engaged both upon loading and during propulsion. These devices can affect the accuracy of the shot both by biasing the arrow during propulsion, and by affecting an archer's tactile control of the drawn arrow. Moreover, some of the devices scrape against the arrow shaft sufficiently to damage the guide fins of conventional arrows. Additional arrow holding devices completely surround the periphery of an arrow shaft and require loading the arrow in a longitudinal rather than lateral manner. Such devices typically have arms which engage and position the arrow shaft both before and during propulsion.

SUMMARY OF THE INVENTION

This invention comprises a unique arrow holding device which, when properly used with a bow, allows an archer to load an arrow onto the support surface of the bow in the conventional lateral manner (i.e. without threading it longitudinally into a loading aperture), and yet confines the loaded arrow such that if the arrow is dislodged from the support surface in any lateral direction, it is restrained and allowed to fall back onto the support surface. Moreover, the lateral confinement is unaffected by repeated drawing and retracting of the loaded arrow, and thus the bow may be tilted without fear that the arrow shaft will separate from the bow. These advantages are achieved in the described device without engaging the loaded arrow during normal operation, and without creating any more obstruction to the arrow guide fins than that which is presented by the body of the bow. Consequently, an archer's accuracy and control is improved without the need for inconvenient and time-consuming adjustments. Means are also disclosed for vertically and horizontally adjusting the arrow holder without removing it from the bow.

Further objects, features, and advantages of the loaded arrow holder invention will be apparent from the following detailed description when taken in conjunction with the accompanying drawings.

DETAILED DESCRIPTION OF THE PREFERRED EMBODIMENT

Figure 1:
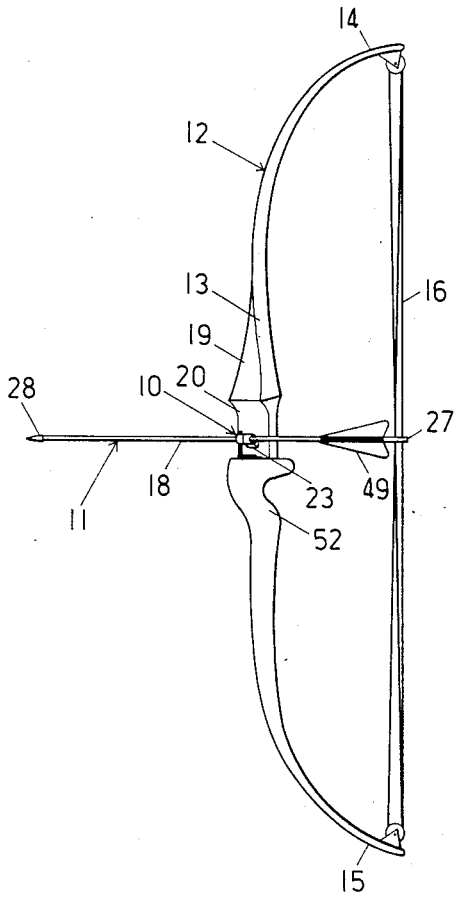
FIG. 1 is a perspective view of a bow with an arrow holder of this invention, showing a right-handed bow with a three-fletched arrow loaded thereon.
Figure 2:
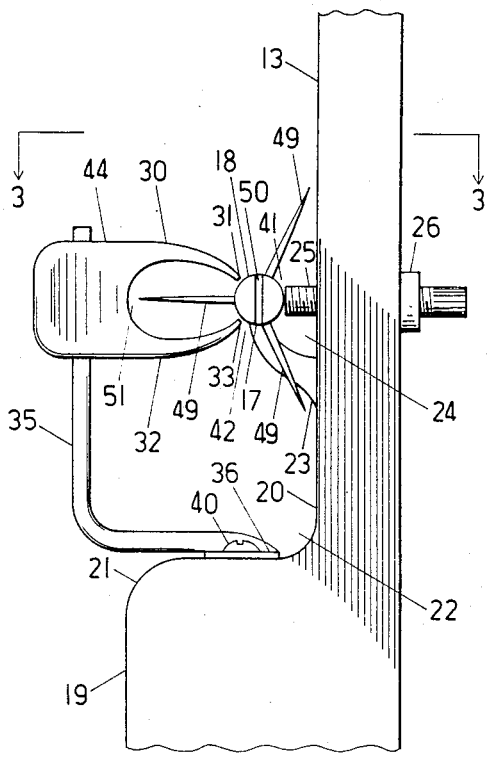
FIG. 2 is a rear view of the central section of the body of the bow in FIG. 1.

The arrow holder of this invention is shown generally as 10 in FIG. 1 and is used for holding arrow 11 in position in bow 12. The bow 12 has a body 13 with an upper end 14, a lower end 15 and a bow string 16 strung between the upper end and the lower end. As best shown in FIG. 2, the body 13 has a support surface 17 adapted to support the generally cylindrical shaft 18 of arrow 11 on one side of the body 13, approximately midway between its upper end 14 and its lower end 15, and includes side wall 19 along the side of the body upon which the arrow may be loaded. The side wall 19 of the preferred embodiment includes a central wall section 20 which is recessed. As shown in FIG. 2, the central wall section 20, together with the ledge 21, define a window area 22 near the center of the bow, and the support surface 17 is preferably located on an arrow rest 23 such that the shaft 18 is supported within the window area. In any case, the body 13 has a conventional arrow restraining means for restraining arrows dislodged from the support surface 17 toward the side wall 19 such that the shaft 18 of the arrow is allowed to fall back onto the support surface 17. The arrow restraining means may consist only of the surface of side wall 19 itself if the side wall is positioned sufficiently close to the support surface. In the preferred embodiment, however, there is a gap 24 between the central wall section 20 and the support surface 17, and the restraining means also comprises a pin 25 which projects from the side wall toward the support surface such that the shaft 18 of an arrow dislodged from the support surface toward the side wall 19 is prevented from falling within the gap 24. Preferably the pin 25 extends through the body 13 and is threadably engaged by a knob 26 fixed to the body 13 such that the degree to which the pin projects toward the support surface 17 may be adjusted by the user. The restraining means may either be positioned such that it is spaced from an arrow shaft 18 supported on the support surface 17 or it may be positioned to abut the supported shaft. In some embodiments, or if the bow 12 is tilted from the vertical, the pin 25 may even partially support the weight of the arrow 11.

The arrow 11 is shown in FIG. 1 in a loaded but undrawn position, that is, with its nock end 27 positioned on the undrawn bow string 16, and its shaft 18 supported on the support surface 17. It is often convenient for archers to achieve this position by nocking the nock end 27 to the bow string 16 substantially simultaneously with placing the shaft 18 of the arrow 11 on the support surface 17. That is, the shaft 18 may be advanced without obstruction to the support surface 17 by moving the arrow laterally with respect to its longitudinal axis. Lateral movement as so described may generally have horizontal and vertical components, and it may even include forward and rearward components. What is important to this invention is that the circumference of the arrow shaft may be directly loaded through an unobstructed passage to the support surface 17 without the need to thread either the nock end 27 or the point end 28 of the arrow over the support surface. When properly used with bow 12, the arrow holder 10 of this invention allows a user to load an arrow 11 onto the bow in this convenient manner without time-consuming adjustments. In addition, the arrow holder 10 is structured to confine a loaded arrow such that whenever the arrow shaft 18 is dislodged from the support surface 17 horizontally, vertically or in any other lateral direction, it is restrained and allowed to fall back onto the support surface. Lateral confinement as so described includes both vertical and horizontal restraint. As best shown in FIG. 2, the arrow holder 10 has a first prong 30 having a first prong tip 31 and a second prong 32 having a second prong tip 33. Each of the prongs 30 and 32 is mounted to a positioning means for positioning the arrow holder with respect to the body 13 of the bow 12. In the preferred embodiment the positioning means for both prongs 30 and 32 includes a rigid stem 35.

The arrow holder may be fastened to the body 13 by use of conventional fastening means. Preferably, however, as just shown in FIG. 2, FIG. 3 and FIG. 4, the positioning means has a fastening pad 36 adapted to be adjustably fastened onto the ledge 21 below the support surface 17 and below the unobstructed passage through which the arrow shaft is advanced to the support surface. Specifically the fastening pad has two parallel slots 37 and 38 and the fastening means for fastening the arrow holder to the bow includes screws 39 and 40 which respectively pass through the slots. The position of the stem 35 may be adjusted along the slots 37 and 38 while screws 39 and 40 are loose; and tightening of the screws clamps the stem in position on the body 13.

Figure 3:
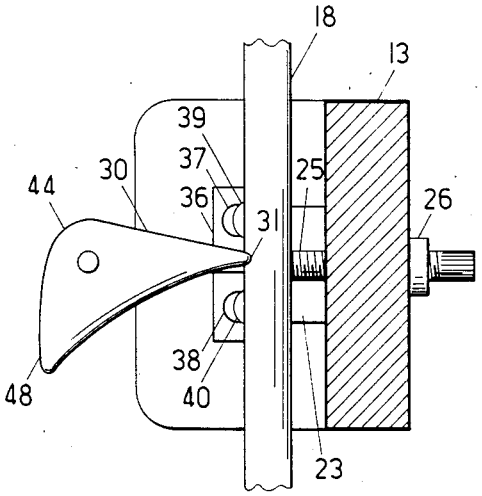
FIG. 3 is a top view of the central section of the body of the bow as viewed along Section 3—3 in FIG. 2, showing the arrow holder in its closed position.
Figure 4:
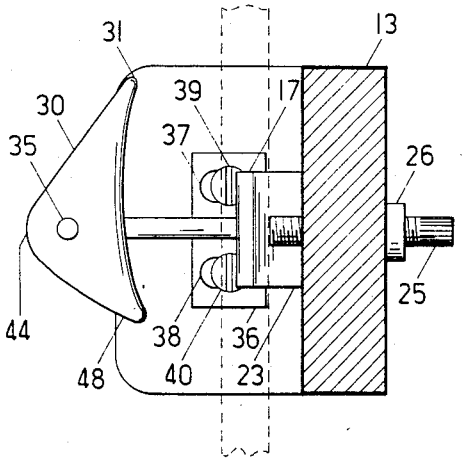
FIG. 4 is the central section of the body of the bow as shown in FIG. 3 with the arrow holder in its open position with a shaft of a loaded arrow shown in phantom.

At least one of the prongs 30 and 32 are movable such that when the arrow holder 10 is properly fastened to a bow and positioned thereon the prongs have an open position in which an arrow shaft 18 may be laterally advanced to the arrow support surface 17 without obstruction, and a closed position in which an arrow shaft placed upon the support surface is laterally confined. Such reversible movement can be accomplished using various conventional means of translation or rotation. For the preferred embodiment herein described, it is important that at least one of the prongs 30 and 32 is rotatably mounted to the positioning means such that opening and closing the arrow holder is accomplished by prong rotation. Specifically, when the arrow holder is in the closed position, as shown in FIGS. 2 and 3, the first prong tip 31 is adapted to be positioned above the support surface 17 and less than one arrow shaft diameter from the restraining means of the bow 12 so that an arrow shaft 18 loaded onto the support surface 17 is prevented from passing between the first prong 30 and the restraining means; and the second prong tip 33 is adapted to be positioned substantially adjacent to an arrow shaft loaded onto the support surface on the side of the shaft opposite the restraining means, less than one arrow shaft diameter from support surface so that the arrow shaft is prevented from passing between the second prong 32 and the support surface, and less than one arrow shaft diameter from prong tip 31 so that the arrow shaft is prevented from passing between the prong tips 31 and 33. The arrow shaft 18 is thus unable to laterally pass through the channel 41 between the first prong and the restraining means, or between the void 42 which remains between the second prong and the support surface, and there is no space between the first prong and the second prong through which the shaft may pass. Consequently when the arrow holder is closed a shaft placed on the support surface is laterally confined. When the arrow holder is in its open position as shown in FIG. 4, the prong 30 is rotated and channel 41 is enlarged so that the shaft 18 of the arrow 11 may be laterally loaded onto the support surface 17 by passing without obstruction between the prong tip 31 and the restraining means. The position of a loaded arrow shaft is shown by the broken lines in FIG. 4. The preferred embodiment as shown in FIGS. 2 through 6 includes a head portion 44 which is rotatably mounted onto the stem 35. In this embodiment the prongs 30 and 32 both extend from the head portion 44 and consequently both prongs rotate as the prongs are moved between the open and closed positions.

The prongs 30 and 32 may be positioned such that they abut the supported shaft. In some embodiments or bow orientations prong 32 may even partially support the arrow 11. However, in the preferred embodiment both prongs are positioned such that when the bow is held upright they are spaced from the arrow shaft 18 as it is supported on the support surface 17. This spacing minimizes the effect of the arrow holder 10 on the flight of a shot arrow, and allows the archer to judge the tension of a drawn arrow without interference from the arrow holder.

Figure 5:
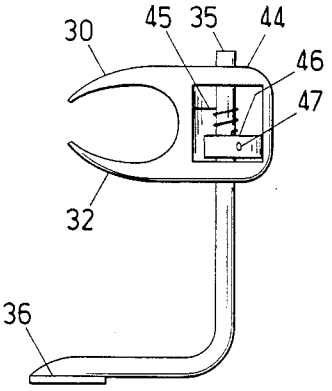
FIG. 5 is an isolated front view of the arrow holder in FIG. 2 in its closed position showing its biasing spring.
Figure 6:
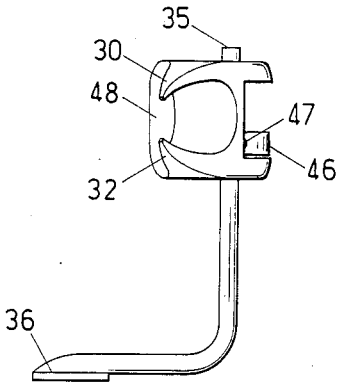
FIG. 6 is a front view of the arrow holder of FIG. 5 with the arrow holder in its fully opened position.

It is important that the arrow holder remain in its closed position even when the arrow is repeatedly moved longitudinally as by drawing the arrow, and then retracted it without shooting. Where the arrow shaft 18 is spaced from the prongs 30 and 32 as described above, there is normally no frictional drag between the moving shaft and the arrow holder which might inadvertently shift an arrow holder from its closed position to its open position. Nevertheless, the arrow holder 10 preferably has a biasing means for biasing the prongs toward the closed position. As best shown in FIG. 5, the biasing means of the preferred embodiment comprises a biasing spring 45 which presses against the head portion 44 and is anchored to the peg 46 engaging stem 35. Peg 46 is clamped to the stem 35 and limits the mobility of the head portion 44 along the stem. The peg 46 is preferably elongated at its base such that the peg also limits the rotation of the head portion 44 by engaging the head portion at a first location when the arrow holder is fully opened (as shown in FIG. 6) and engaging the head portion at a second location when the arrow holder is in its closed position (as shown in FIG. 5). Thus peg 46 of the preferred embodiment functions as a stop means for limiting the extent of rotation of head portion 44 on stem 35, and the biasing spring 45 biases the prongs to the closed position. In the preferred embodiment the stem 35 is threaded through the peg 46 and the peg is reversibly clamped to the stem 35 by setscrew 47. Thus the position of the prongs 30 and 32 may be adjusted along the stem while the setscrew 47 is loose and tightening the setscrew fixes the prongs in position. Moreover, the peg 46 and consequently the head portion 44 may be rotatably adjusted on the stem 35 while the setscrew 47 is loose thereby adjusting the open and closed positions of the arrow holder, and tightening the setscrew also fixes the positions of the rotation limits of the head portion with respect to the stem 35. This vertical adjustability of the head portion 44 along the stem 35 together with the horizontal adjustability of the fastening pad 36 along the ledge 21 provide a means for vertically and horizontally adjusting the arrow holder without removing it from the bow. As shown in FIG. 4, the head portion 44 may be provided with a thumb tab 48 to allow an archer grasping the bow handle 52 with one hand to conveniently push the arrow holder to its open position with the extended thumb of that same hand.

Arrows are commonly produced with either three guide fins regularly spaced around the shaft (i.e. 120° angles between the guide fins), or with four guide fins conventionally spaced around the shaft at alternating angles at approximately 70° and 110°. The guide fins extend in a generally radial manner from near the rear of the shaft, and the nock end of each type of arrow generally contains a groove which is consistently oriented with respect to the guide fins. While the guide fins are normally planar, arrows with spinal fins have been developed. In any case, the guide fins are frequently comprised of feathers glued to the shaft. Consequently, the guide fins are relatively delicate and any reduction in the scraping or rubbing of the fletches during a shot can prolong the life of an arrow. Moreover, an archer's accuracy is frequently improved by using a bow which minimizes arrow contact with the bow body as the arrow is being shot.

The conventional groove orientation for three-fletched arrows is shown in FIG. 2, with one of the guide fins 49 perpendicular to the groove 50 and the other guide fins 49 regularly spaced therefrom around the shaft. Because of the standard arrow design, it is possible to produce bow designs which account for the position of the guide fins 49 and substantially minimize the undesirable wear of the guide fins during shooting. FIG. 2 demonstrates use of a bow with an arrow holder of this invention which is constructed to avoid additional contact between the bow and the guide fins 49 of a three-fletched arrow during shooting. Specifically, a cavity 51 is provided between the first prong 30 and the second prong 32, which cavity is sized to allow one of the guide fins to pass therethrough when the arrow holder is closed. In addition, the first prong tip 31 is positioned so that the channel 41 between it and the restraining means is sufficiently wide when the arrow holder is closed to allow a second guide fin to pass therethrough. Moreover, in some bow designs (not shown) the arrow rest can be lengthened and the gap 24 between the support surface and the side wall can be sized to allow even the third fletch to pass unobstructedly by the body 13 during a shot.

The inventor has found that operable dimensions for the three-fletched embodiment shown in FIGS. 1 through 6 may include the following: Prong tips 31 and 33 are each rounded and 1/16 inch thick, and are separated from each other by $\frac{1}{4}$ inch, cavity 51 is approximately $\frac{3}{4}$ inch long, and expands from the $\frac{1}{4}$ inch separation between the prong tips 31 and 33, to a height of $\frac{1}{2}$ inch. The end of the cavity 51 opposite the tips 31 and 33 is concavely rounded at $\frac{1}{2}$ inch radius. The head portion of this operable embodiment extends from the cavity 51 an additional $\frac{5}{8}$ inch in length away from the tips 31 and 33, has a width of approximately $\frac{3}{4}$ inch including the thumb tab 48, and has a height of approximately $\frac{3}{4}$ inch. The head portion 44 is mounted onto a round stem 35 having a diameter of approximately $\frac{1}{8}$ inch. An arrow holder constructed in accordance with these dimensions may be used with a standard three-fletched arrow having either planar guide fins 49 as shown in FIG. 2 or spiral guide fins (not shown) and may be used with arrow shafts of having standard diameters of approximately $\frac{1}{3}$ of an inch.

Figure 7:
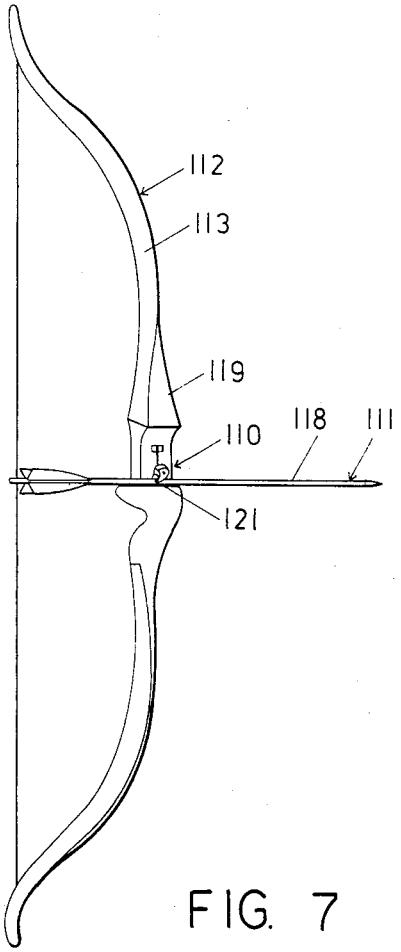
FIG. 7 is a perspective view of a second embodiment showing a left-handed bow with a four-fletched arrow loaded and drawn thereon.
Figure 8:
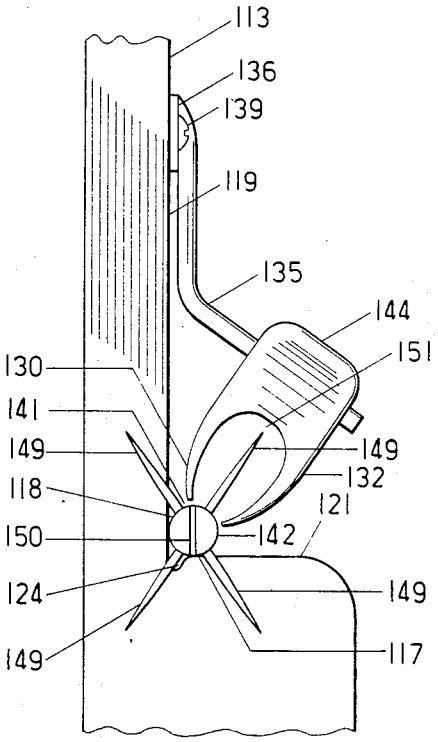
FIG. 8 is a rear view of the central section of the body of the bow in FIG. 7.

FIGS. 7 and 8 demonstrate another embodiment of a bow with an arrow holder of this invention. Parts analogous to those described for the preferred embodiment presented in FIGS. 1 and 2 are identified by analogous 100 series numbers. FIGS. 7 and 8 show use of an arrow holder 110 mounted above the support surface 117 and above the passage through which the arrow shaft 118 may be advanced unobstructedly to the support surface. The left-handed bow 112 uses a portion of ledge 121 as the support surface 117 and the surface of side wall 119 as the restraining means. The arrow holder is shown in FIG. 8 in its closed position with the shaft 118 of arrow 111 loaded onto the support surface 117 and laterally confined. As with the preferred embodiment shown in FIGS. 1 through 6, a first prong 130 and a second prong 132 are rotatably mounted to a stem 135 which is fastened to the body 113 by means of screw 139 which extends through fastening pad 136. A means is provided for vertically and horizontally adjusting the arrow holder without removing it from the bow. In this embodiment, however, the adjustable fastening pad uses slots (not shown) for vertical adjustment, while adjustment of the head portion 144 along the stem 135 has horizontal and vertical components. Rotation of the prongs 130 and 132 allows an arrow shaft to be laterally loaded without obstruction. In this embodiment, however, it is the rotation of the second prong 132 as the arrow holder is moved to its open position which is most important because such rotation allows an arrow shaft 118 to laterally pass between the second prong and the support surface 117. Of course since both prongs 130 and 132 extend from a common head portion 144 they will both rotate as the prongs are moved between the open and closed positions.

Figure 9:
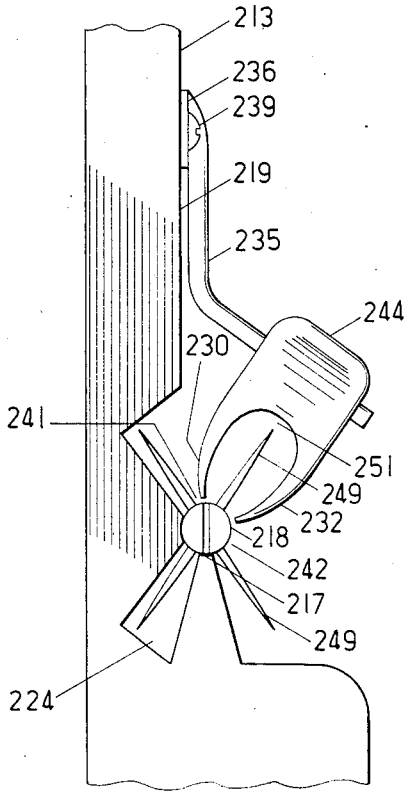
FIG. 9 is a rear view of the central section of a bow with a body adapted to minimize guide fin wear and with an arrow holder.

The embodiment shown in FIG. 8 has been designed for use with a standard four-fletched arrow where the slot 150 is positioned to form a 35° angle with each of the guide fins 149. As seen in that figure, the cavity 151 between the first prong 130 and the second prong 132 can be sized and positioned to allow one of the guide fins 149 to pass through the cavity when the arrow holder is closed. It is apparent from the figure that use of a raised arrow rest analogous to that in FIG. 2 or an abruptly stepped ledge would allow a second fletch to pass unobstructed through void 142 when the arrow holder is closed. The body 113 of bow 112 may also be shaped to allow a third fletch to pass unobstructed through the channel 141 located between the first prong 130 and the side wall 119 when the arrow holder is closed. Moreover, as with the preferred embodiment shown in FIG. 2 and described above, a bow design which enlarges the gap 124 between the support surface and the side wall could allow even the last fletch to pass unobstructedly by the body during a shot. An embodiment which incorporates these modifications to allow four fletches to pass unobstructedly is shown in FIG. 9, where parts analogous to those described in FIG. 8 are identified by analogous 200 series numbers.

Figure 10:
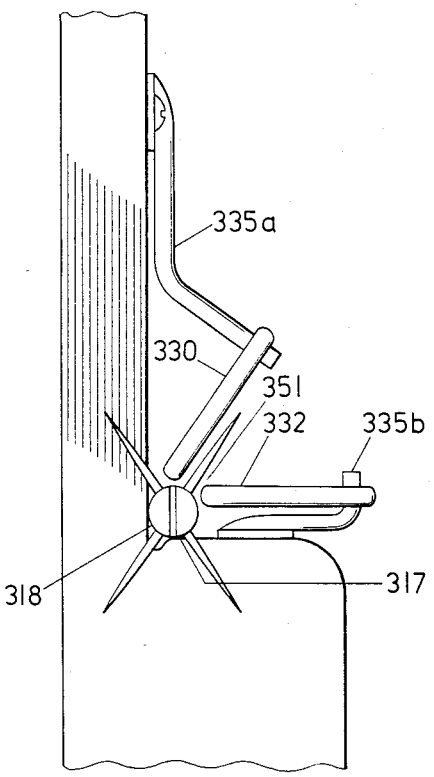
FIG. 10 is a rear view of the central section of a bow with a third embodiment of an arrow holder.

FIG. 10 represents another embodiment within the scope of this invention, wherein two prongs are separately fastened to the body of an arrow. Parts analogous to those of the preferred embodiment in FIG. 2 are identified in FIG. 10 by analogous 300 series numbers. The positioning means includes stem 335*a* and stem 335*b*, and the first prong 330 is rotatably mounted to stem 335*a* while the second prong 332 is rotatably mounted to stem 335*b*. The embodiment shown in FIG. 10 is in its closed position. In this embodiment rotation of either the first prong 330 or the second prong 332 allows an arrow shaft 318 to be laterally advanced to the support surface 317 through cavity 351. The stems 335*a* and 335*b* are thus respectively mounted above and below the passage through which the arrow shaft 318 may be advanced unobstructedly to the support surface 317.

It is understood that the invention is not limited to the particular construction, arrangement of parts, steps or materials herein illustrated and described but embraces all such modified forms thereof as come within the scope of the following claims.

What is claimed is:

1. An arrow holder device in combination with a bow and an arrow having a generally cylindrical arrow shaft, said bow having a body with a side wall along the side of the body upon which the arrow may be loaded, said bow further having an arrow support surface for supporting the shaft of the arrow loaded thereon, said bow further having an arrow restraining means for restraining the arrow dislodged from the support surface toward the side wall such that the shaft of the arrow is allowed to fall back onto the support surface, the arrow holder comprising:

(a) at least one arrow holder positioning means for positioning the arrow holder with respect to the body of the bow, which positioning means is adapted to be fastened to the bow;

(b) a plurality of prongs mounted on the positioning means and positionable with respect to an arrow shaft placed upon the arrow support surface so that the prongs have a closed position in which the arrow shaft may be repeatedly moved longitudinally, in which a first prong extends above the arrow support surface to a position less than one arrow shaft diameter from the arrow restraining means, in which a second prong extends substantially adjacent to the arrow shaft on the side of the shaft opposite the restraining means to a position less than one arrow shaft diameter from the support surface, and in which there is no space between the first prong and the second prong through which the arrow shaft may pass, thereby laterally confining the arrow shaft; at least one of said prongs being movably mounted to the positioning means so that the prongs have an open position in which there is a passage between a movably mounted prong and the support surface which is greater than the diameter of an arrow shaft such that the shaft of an unloaded arrow may be laterally loaded without obstruction onto the arrow support surface.

2. The arrow holder of claim 1 wherein the positioning means includes a fastening pad having at least one longitudinal slot; and further comprising screws which extend through each slot and may be reversibly tightened to the body such that the position of the positioning means may be adjusted to the longitudinal extent of the slots when the screws are loose, but is fixed relative to the body when the screws are tightened.

3. The arrow holder of claim 1 wherein the first prong is movable.

4. The arrow holder of claim 3 wherein the first prong is rotatably mounted to the positioning means such that the first prong rotates as the prongs move between the open and closed positions.

5. The arrow holder of claim 3 further comprising fastening means for fastening the positioning means to the bow at a point below the passage through which the arrow shaft may be advanced unobstructedly to the support surface.

6. The arrow holder of claim 1 wherein the second prong is movable.

7. The arrow holder of claim 6 wherein the second prong is rotatably mounted to the positioning means such that the second prong rotates as the prongs move between the open and closed positions.

8. The arrow holder of claim 1 further including a portion from which the prongs extend.

9. The arrow holder of claim 8 wherein the head portion includes a thumb tab positioned to allow an archer to move the prongs between the open and closed position by exerting force on the thumb tab.

10. The arrow holder of claim 8 wherein the head portion is rotatably mounted to the positioning means.

11. The arrow holder of claim 10 further comprising biasing means for biasing the prongs toward the closed position.

12. The arrow holder of claim 10 wherein the positioning means includes a stem adapted to be fastened to the bow, and wherein the head portion is positioned along the stem by a peg with a setscrew which may be reversibly tightened to the stem such that the position of the prongs may be adjusted along the stem.

13. The arrow holder of claim 10 further comprising a stop means for limiting the extent of rotation of the head portion, which stop means may be rotatably adjusted on the stem thereby adjusting the open and closed positions of the prongs.

14. The arrow holder of claim 1 wherein the prongs are positionable such that when the prongs are in the closed position the arrow holder does not touch an arrow shaft supported upon the support surface.

15. The arrow holder of claim 1 particularly adapted for use with an arrow having a plurality of guide fins extending from the shaft, wherein there is a cavity between the first prong and the second prong which cavity is such that when the prongs are closed, the arrow holder is properly fastened to the bow and an arrow is shot, one guide fin may pass through the cavity and the remaining guide fins are unobstructed by the arrow holder.

16. The arrow holder positioning means of claim 1 further comprising means for vertically and horizontally adjusting the arrow holder when it is fastened to a bow without removing it from the bow.

17. An arrow holder in combination with an arrow having a generally cylindrical shaft and a plurality of guide fins extending from the shaft, and adapted to be fastened to a bow having a body with a side wall along the side of the body upon which the arrow may be loaded, an arrow support surface for supporting the shaft of an arrow loaded thereon, and an arrow restraining means for restraining loaded arrows dislodged from the support surface toward the side wall such that the shaft of the arrow is allowed to fall back onto the support surface, the arrow holder comprising:

(a) a stem adapted to be fastened to the bow and to position the arrow holder with respect to the bow;

(b) fastening means for fastening the stem to the bow;

(c) a head portion rotatably mounted to the stem and having a thumb tab positioned to allow an archer to rotate the head portion by exerting force on the thumb tab;

(d) a first prong extending from the head portion and rotatable therewith which has a first prong tip and is positionable with respect to an arrow shaft placed upon the arrow support surface such that it may be rotated between a closed position in which the prong tip is positioned above the arrow support surface and less than one arrow shaft diameter from the restraining means, and an open position in which the shaft of an arrow may be laterally loaded onto the arrow support surface without obstruction by passing between the first prong and the restraining means;

(e) a second prong extending from the head portion which forms a cavity between the first prong and the second prong, has a second prong tip, and is positionable with respect to an arrow shaft placed upon the arrow support surface such that when the first prong is in closed position the second prong tip is positioned substantially adjacent to the arrow shaft on the side of the shaft opposite the restraining means at less than one arrow shaft diameter from both the arrow support surface and the first prong tip so as to prevent an arrow shaft from passing between the second prong and the support surface and to prevent the arrow shaft from passing between the first prong and the second prong; the cavity, the first prong and the second prong being sized such that when arrow holder is properly fastened to the bow with the first prong in its closed position, one guide fin may pass through the cavity and the remaining guide fins are unobstructed by the prongs; and (f) a biasing spring located between the stem and the head portion which biases the head portion toward a position in which the first prong is in a closed position.

18. The arrow holder of claim 17 wherein the head portion is positioned along the stem by a peg having an elongated base which limits the extent of rotation of the head portion, and a setscrew which be reversibly tightened to the stem such that the position of the first prong and the second prong may be adjusted along the stem, and the open and closed positions of the first prong may be adjusted.

19. The arrow holder of claim 17 wherein the stem is rigidly supported on a fastening pad having at least one longitudinal slot; and wherein the fastening means includes screws which extend through each slot and may be reversibly tightened to the body such that the position of the stem may be adjusted to the longitudinal extent of the slots when the screws are loose, but is fixed relative to the body when the screws are tightened.

20. The arrow holder of claim 18 particularly adapted for use with an arrow having three regularly spaced guide fins wherein the first prong tip and the second prong tip are each rounded and 1/16 inch thick; wherein the first prong tip and the second prong tip are spaced from each other by $\frac{1}{4}$ inch; wherein the cavity is approximately $\frac{3}{4}$ inch long and expands from $\frac{1}{4}$ inch separation between the first prong tip and the second prong tip to a height of approximately $\frac{1}{2}$ inch; the end of the cavity being concavely rounded at a radius of approximately $\frac{1}{2}$ inch; wherein the head portion extends approximately $\frac{5}{8}$ inch in length further than the cavity, has a width of approximately $\frac{3}{4}$ inch including the thumb tab, and has a height of approximately $\frac{3}{4}$ inch; and wherein the stem has a diameter of approximately $\frac{1}{8}$ inch.

21. A bow and arrow combination, said bow having an arrow holder for use with said arrow having a shaft and a plurality of guide fins extending from the shaft, the bow comprising:

(a) a body with a side wall along the side of the body upon which the arrow may be loaded;

(b) an arrow rest positioned along the side wall and having a support surface adapted to support the shaft of the arrow near the center of the body;

(c) an arrow restraining means for restraining arrows dislodged from the support surface toward the side wall such that the shaft of the arrow is allowed to fall back onto the support surface;

(d) at least one arrow holder positioning means for positioning the arrow holder with respect to the body of the bow;

(e) a fastening means for fastening the positioning means to the body;

(f) a plurality of prongs mounted on the positioning means and positionable with respect to an arrow shaft placed upon the arrow support surface so that the prongs have closed position in which the arrow shaft may be repeatedly moved longitudinally, in which a first prong extends above the arrow support surface to a position less than one arrow shaft diameter from the arrow restraining means, in which a second prong extends substantially adjacent to the arrow shaft on the side of the shaft opposite the restraining means to a position less than one arrow shaft diameter from the support surface, and in which there is no space between the first prong and the second prong through which the arrow shaft may pass, thereby laterally confining the arrow shaft; at least one of said prongs being movably mounted to the positioning means so that the prongs have an open positon in which there is a passage between a movably mounted prong and the support surface which is greater than the diameter of an arrow shaft such that the shaft of an unloaded arrow may be laterally loaded without obstruction onto the arrow support surface.

22. The bow of claim 21 further comprising means for vertically and horizontally adjusting the arrow holder positioning means without removing it from the bow.

23. The bow of claim 22 wherein the restraining means includes a pin which projects from the side wall toward an arrow shaft placed on the support surface, the pin being adjustably engaged to the body such that the degree to which the pin projects toward the arrow shaft may be adjusted.

24. The bow of claim 22, wherein the positioning means includes a stem rigidly fastened to a fastening pad having at least one longitudinal slot; wherein the fastening means includes screws which extend through each slot and may be reversibly tightened to the body such that the position of the stem may be adjusted to the longitudinal extent of the slots when the screws are loose, but is fixed relative to the body when the screws are tightened; and further comprising a head portion which is rotatably mounted to the stem, which head portion is positioned along the stem by a peg having an elongated base which limits the extent of rotation of the head portion and a set screw which may be reversibly tightened to the stem such that the position of the head portion may be adjusted along the stem, and the open and closed positions of the prongs may be adjusted.

25. The bow of claim 21 wherein when the prongs are closed and the bow is held upright neither the arrow holder nor the restraining means touches an arrow shaft supported on the support surface.

26. The bow of claim 21 wherein there is a cavity between the first prong and the second prong which cavity is sized and positioned such that when the prongs are closed and an arrow is shot one guide fin may pass through the cavity and the remaining guide fins are unobstructed by the prongs.

27. The bow of claim 26 wherein there is a channel between the first prong and the restraining means, which is sized and positioned such that when the prongs are closed and an arrow is shot one guide fin may pass through the channel.

28. The bow of claim 21 wherein the side wall is recessed such that the support surface is located within a window area.

* * * * *